US011364593B2

(12) United States Patent
Jacobson et al.

(10) Patent No.: US 11,364,593 B2
(45) Date of Patent: Jun. 21, 2022

(54) BEAM CLAMP FIXTURE

(71) Applicant: Bertsche Engineering Corp., Buffalo Grove, IL (US)

(72) Inventors: Steve E. Jacobson, Mundelein, IL (US); Tristan W. Bertsche, Evanston, IL (US)

(73) Assignee: BERTSCHE ENGINEERING CORP., Buffalo Grove, IL (US)

( * ) Notice: Subject to any disclaimer, the term of this patent is extended or adjusted under 35 U.S.C. 154(b) by 455 days.

(21) Appl. No.: 16/697,488

(22) Filed: Nov. 27, 2019

(65) Prior Publication Data

US 2021/0154800 A1 May 27, 2021

(51) Int. Cl.

| | |
|---|---|
| ***B25B 5/00*** | (2006.01) |
| ***B25B 5/14*** | (2006.01) |
| ***B25B 5/06*** | (2006.01) |

(52) U.S. Cl.

CPC ..... *B25B 5/003* (2013.01); *B25B 5/06* (2013.01); *B25B 5/14* (2013.01)

(58) Field of Classification Search

CPC B25B 1/00; B25B 1/04; B25B 1/2405; B25B 3/00; B25B 5/00; B25B 5/04; B25B 5/107; B23Q 3/00; B23Q 3/06; B23Q 3/067; B23Q 3/152

See application file for complete search history.

(56) References Cited

U.S. PATENT DOCUMENTS

| | | | | |
|---|---|---|---|---|
| 5,688,014 | A * | 11/1997 | Kot | B25B 5/12 294/99.1 |
| 6,158,729 | A * | 12/2000 | Tsai | B25B 5/12 269/201 |
| 2007/0267799 | A1* | 11/2007 | Dykstra | B25B 5/08 269/228 |
| 2015/0145194 | A1* | 5/2015 | Kaiser | B44B 5/0052 269/32 |
| 2015/0145195 | A1* | 5/2015 | Fukui | B25B 5/122 269/32 |
| 2021/0154800 | A1* | 5/2021 | Jacobson | B25B 5/006 |

* cited by examiner

*Primary Examiner* — Lee D Wilson
(74) *Attorney, Agent, or Firm* — Olson & Cepuritis, Ltd.

(57) ABSTRACT

A fixture for clamping a structural beam during machining is equipped with at least one beam clamp assembly having an elongated clamp arm capable of pivoting as well as linear motion during a clamping operation. The elongated clamp arm is pivotably mounted to a pivot block rotated by an actuator device. The pivot axis of the clamp arm is aligned with but spaced from the axis of rotation of the pivot block.

15 Claims, 7 Drawing Sheets

BEAM CLAMP FIXTURE

FIELD OF INVENTION

This invention relates to workholding devices used to accurately position and hold a workpiece during a machining operation. More particularly, this invention relates to a device for accurately positioning and holding a beam during a machining process.

BACKGROUND OF INVENTION

Machining describes a variety of material removal processes in which a cutting tool removes unwanted material from a workpiece. The principal machining processes are classified as turning, drilling and milling.

Large structural elements such as beams, particularly beams made of materials such as aluminum, and composites such as carbon fiber reinforced polymers (CFRP), and the like, tend to warp during fabrication, however. When such beams are subjected to a precision machining operation, any such warpage must be eliminated and constant beam profile maintained. To that end the beam is clamped against predetermined datum surfaces at least at a machining site, and sometimes along the entire length of the beam.

The beam clamp fixture of the present invention provides a compact and efficient means for maintaining a desired beam profile during machining and is particularly well suited for use with structural members of aircraft such as airplane floor beams, and the like.

SUMMARY OF INVENTION

A beam clamp fixture suitable for holding at least a portion of a beam during a machining operation has at least one clamp arm assembly capable of providing rotary as well as linear movement for a clamp arm engaging a portion of the beam. The clamp arm assembly includes an elongated clamp arm pivotably mounted to a pivot block which is rotated by an actuator.

In particular, the beam clamp fixture includes an actuator with a rotatable actuator shaft which defines an axis of rotation. A rigid pivot block is mounted to the actuator shaft for rotation about the axis of rotation and is provided with a clamp arm shaft offset from the axis of rotation but defining a pivot axis which is axially aligned with, i.e., parallel to, but spaced from the axis of rotation. An elongated clamp arm is pivotably mounted to the clamp arm shaft and can be provided with a pivot limiting protrusion that coacts with the pivot block. The elongated clamp arm terminates at its distal end portion in a hold-down jaw which holds the beam during a machining operation. The pivot block preferably defines a pair of spaced, opposing abutments that coact with the pivot limiting protrusion on the elongated clamp arm and thereby limit the range of linear motion of the elongated clamp arm.

The beam clamp fixture can apply an adjustable hold-down force to a profile beam so as to locate the beam against a datum surface while straightening any warpage that may be present, e.g., in an extruded aluminum beam or a CFRP beam, without causing distortion of the beam.

DESCRIPTION OF PREFERRED EMBODIMENTS

Figure 1:
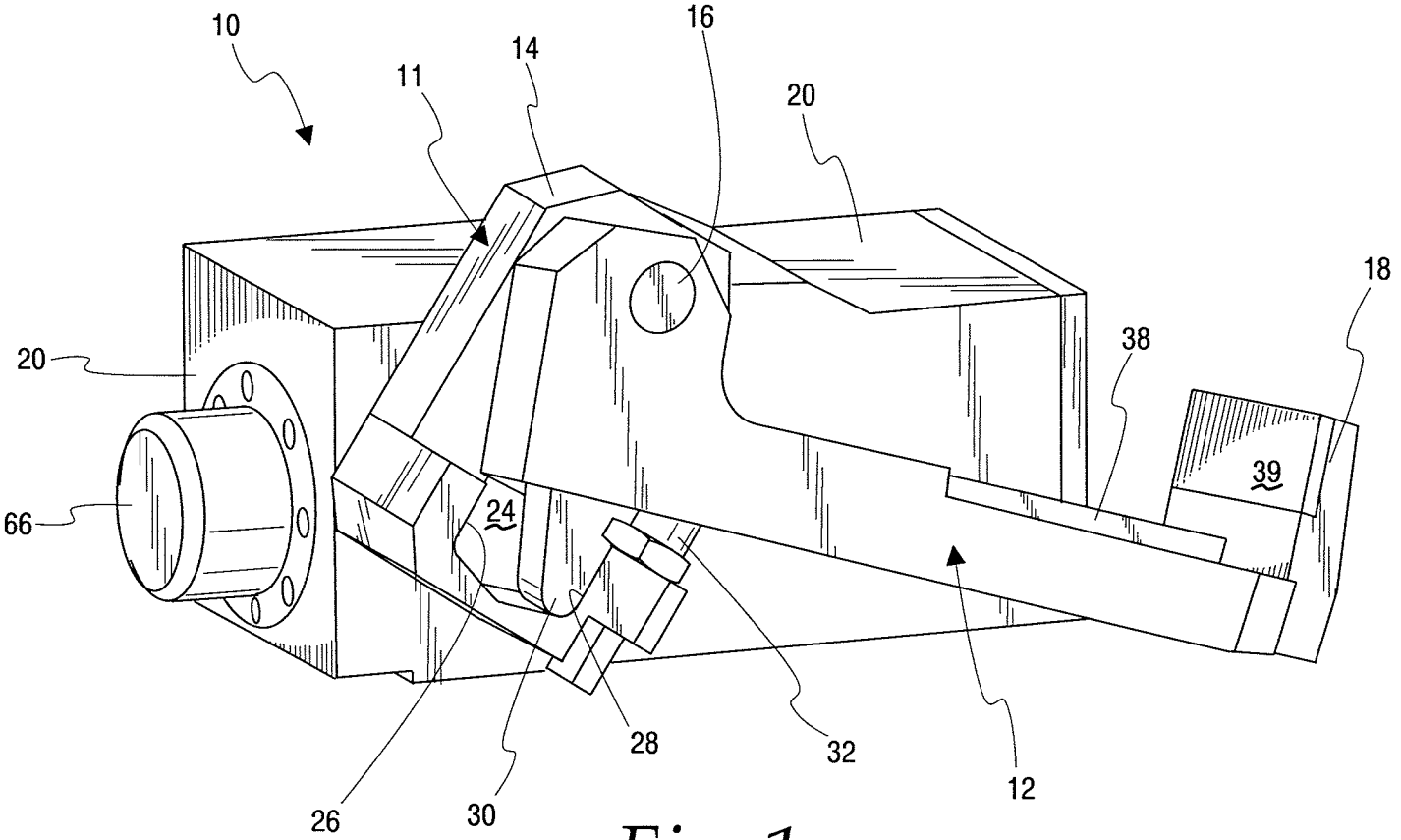
FIG. 1 is a perspective view of a beam clamp fixture embodying the invention.
Figure 2:
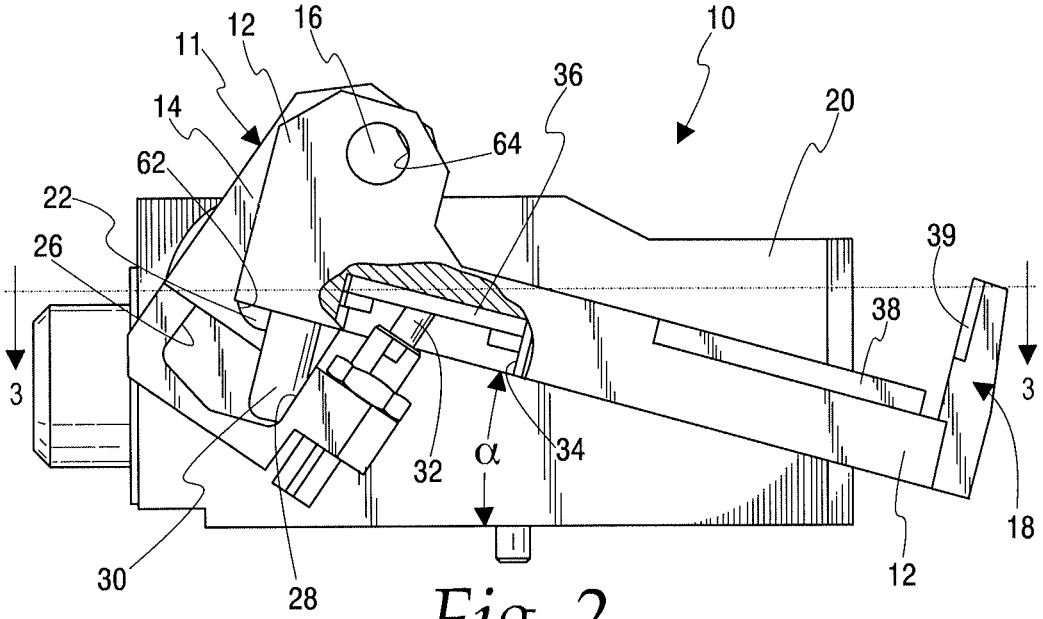
FIG. 2 is a side elevation view of the beam clamp fixture of FIG. 1, partially broken away to show interior detail.

Referring to FIGS. 1 and 2, beam clamp fixture 10 includes a clamp arm assembly 11 constituted by elongated clamp arm 12 pivotably mounted to pivot block 14. Clamp arm 12 is capable of rotary as well as linear motion relative to a stationary beam in response to an actuator which rotates pivot block 14. The actuator is contained in actuator housing 20 and can be a rack and pinion mechanism, a conventional electric motor, a torque motor, and the like. The rack and pinion mechanism can be pneumatically driven, hydraulically driven, or electric motor driven, as desired.

Clamp arm 12 is provided with bore 64 at the proximal end thereof and terminates in a hold-down jaw 18 at the distal end. Rigid pivot block 14 is provided with clamp arm shaft 16 which is pivotably received in bore 64. Clamp arm shaft 16 on pivot block 14 also defines a pivot axis P (FIG. 6) for clamp arm 12.

Actuator shaft 22 (FIG. 2) extends outwardly from actuator housing 20 and can be operably associated with one or more clamp arm assemblies each of which includes a clamp arm such as clamp arm 12 and a pivot block such as pivot block 14. Actuator shaft 22 is keyed in bore 62 of pivot block 14. Actuator shaft 22 also defines an axis of rotation R (FIG. 6) for pivot block 14. Pivot axis P and axis of rotation R are aligned parallel to but spaced from one another. Pivot axis P and axis of rotation R together define a pivot plane. The longitudinal axis of elongated clamp arm 12 intersects the pivot plane at an acute angle when in a beam release position. The spacing D between pivot axis P and axis of rotation R determines the magnitude of clamping force applied to a beam. The applied force is a function of torque applied to actuator shaft 22. A typical spacing between pivot axis P and axis of rotation R is in the range of about 30 millimeters to about 60 millimeters for an applied torque of about 60 Newton-metres (Nm) or about 44.254 foot-pounds (ft-lbs). The applied torque in a given application depends on desired clamping force to be applied to the beam to be machined. When spacing D is about 40 millimeters, an applied torque of 60 Nm results in a clamping force of about 1,500 Newtons (about 337.2 pounds force).

Pivot block 14 defines a contoured pocket 24 and unitary opposed abutments 26 and 28 which coact with protrusion 30 on clamp arm 12 that juts or extends out from clamp arm 12 and coacts with abutments 26 and 28 to limit the pivot range of clamp arm 12 relative to pivot block 14. A preferred rotation range for pivot block 14 relative to clamp arm 12 is about 10 to about 20 degrees of an arc. The overall shape of pivot block 14 is not critical as long as a spacing between axis of rotation R and pivot axis P is maintained.

Figure 11:
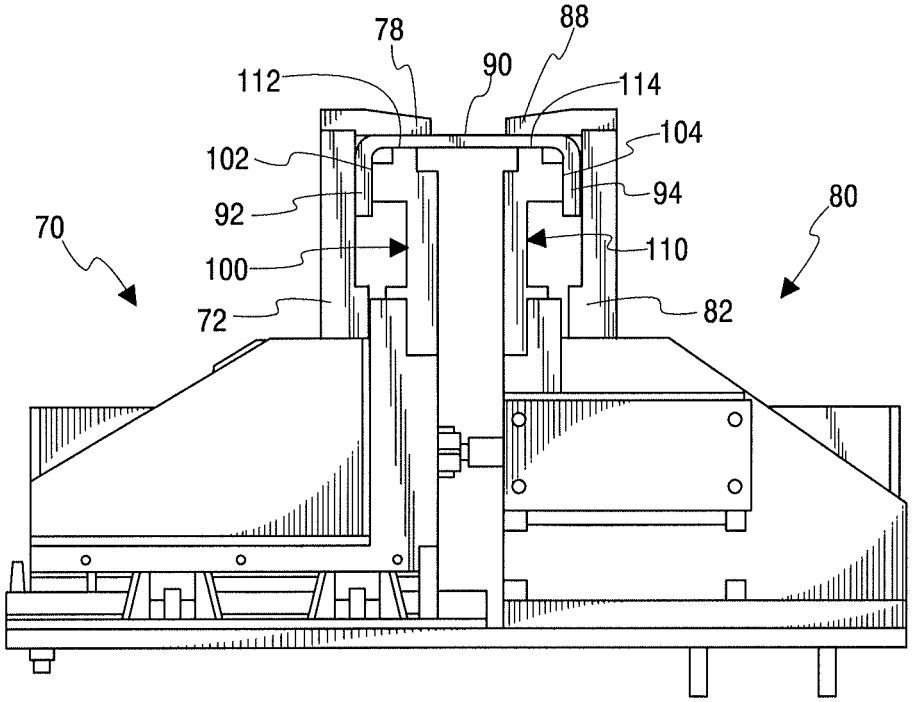
FIG. 11 is a side elevational view of the beam clamp fixture clamping a structural beam.

The range of pivot or swing motion for the elongated clamp arm 12 from a beam release position as shown in FIGS. 1 and 2 to a beam clamping position as shown in FIG. 11 usually is in the range of about 105 degrees to about 110 degrees, preferably about 105 degrees of an arc.

When the clamp arm 12 is in the beam release position, the angle $\alpha$ shown in FIG. 2 preferably is in the range of about 15 degrees to about 20 degrees.

Spring biased plunger 32 is mounted to pivot block 14 adjacent to contoured pocket 28 and is in sliding engagement with clamp arm 12. Preferably, clamp arm 12 defines recess 34 in which plunger 32 is received. Plunger 32 abuts a relatively low friction contact surface such as a polytetrafluoroethylene contact surface provided by polytetrafluoroethylene plate 36 in recess 34. The tip of plunger 32 slides along the polytetrafluoroethylene contact surface as clamp arm is moved to a clamping position.

The surfaces of clamp arm 12 and hold-down jaw 18 that contact the beam to be clamped during the clamping motion can also be provided with a relatively low friction contact surface such as polytetrafluoroethylene plates 38 and 39, if desired. The contact surface material can be rigid or compressible, as desired.

Figure 3:
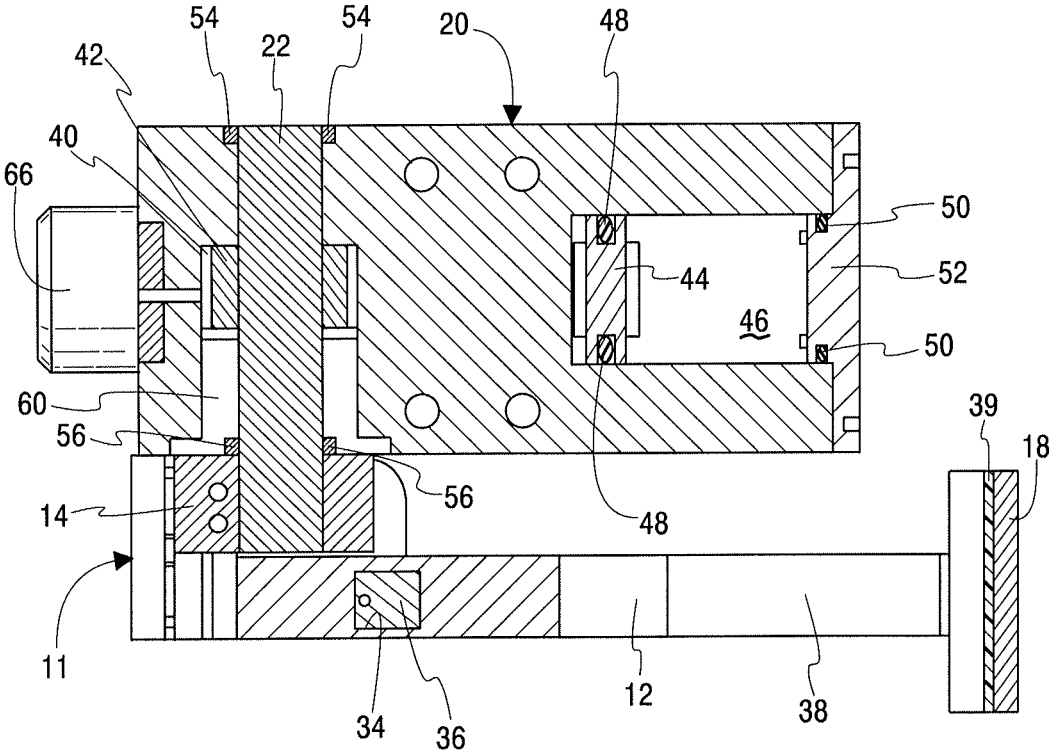
FIG. 3 is a sectional view of the beam clamp fixture shown in FIG. 2, taken along plane 3-3.
Figure 4:
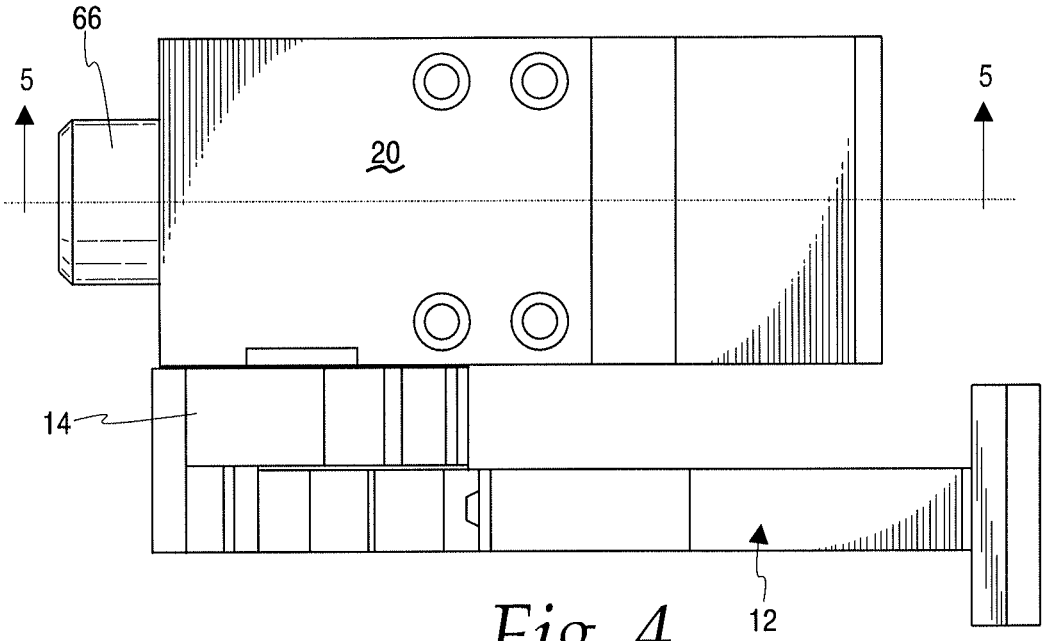
FIG. 4 is a top view of the beam clamp fixture of FIG. 1.
Figure 5:
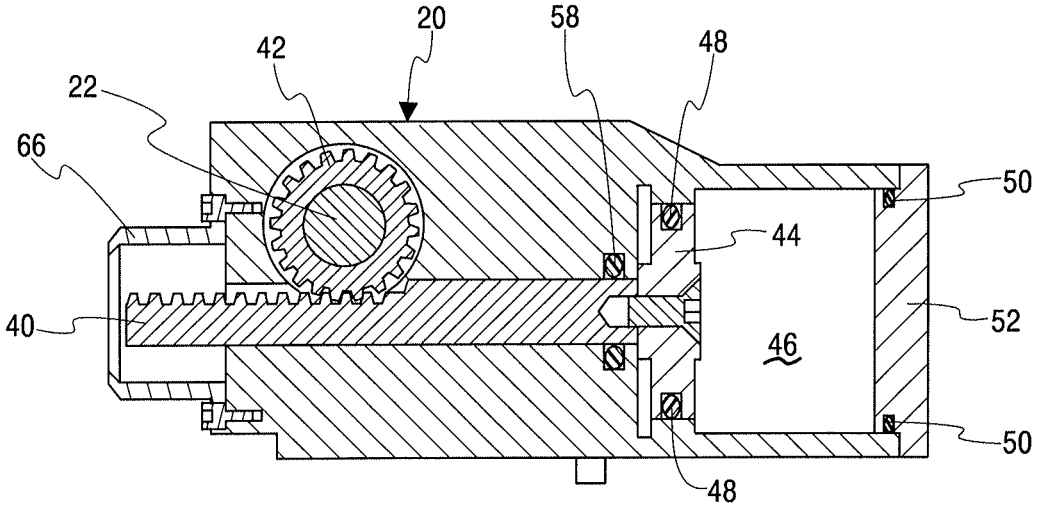
FIG. 5 is a sectional view of the beam clamp fixture shown in FIG. 4, taken along plane 5-5.

FIGS. 3, 4 and 5 show a pneumatically-driven rack and pinion mechanism provided with actuator shaft 22 mounted in actuator housing 20. In particular, actuator shaft 22 carries pinion 42 and engages reciprocating rack 40. Reciprocating motion of rack 40 is controlled by piston 44 at the proximal end portion of rack 40. Piston 44 is situated in chamber 46 which is sealed from ambient atmosphere by cap 52 and o-ring 50. Piston 44 carries o-ring 48. The proximal end portion of rack 40 also is provided with o-ring 58. Protective cap 66 at one end of actuator chamber 20 covers the distal end portion of rack 40.

Bushing 60 in actuator housing 20 receives actuator shaft 22 which carries pinion 42. Felt seals 54, 56 surround actuator shaft 22.

Figure 6:
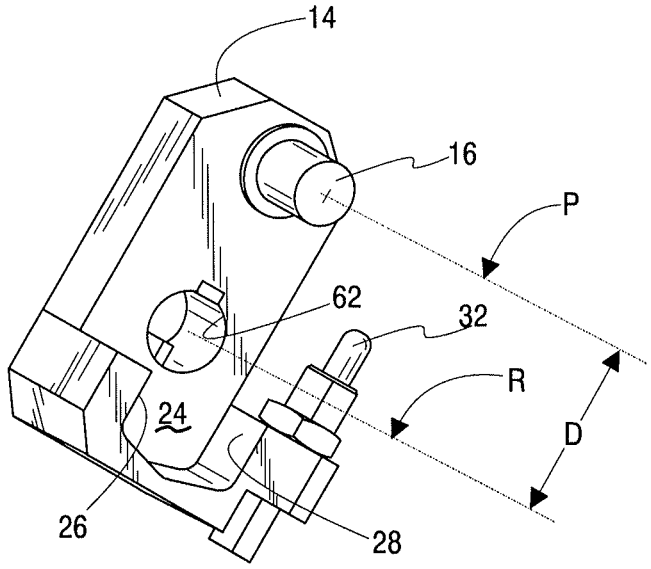
FIG. 6 is a perspective view of a pivot block in the beam clamp fixture shown in FIG. 1.

FIG. 6 shows elongated, rigid pivot block 14 provided with clamp arm shaft 16 at the first end portion thereof. Bore 62 at the first end portion of pivot block 14 is sized to receive actuator shaft 22. Shaft 16 is sized for and is rotatably received in bore 64 of clamp arm 12. Pivot block 14 also defines contoured pocket 24 and opposed abutments 26 and 28 in opposite walls of pocket 24 that limit pivot range for clamp arm 12. Spring-biased plunger 32 is carried on pivot block 14 and is positioned to engage recess 34 in clamp arm 12 as can be seen in FIG. 2. Spring-biased plunger 32 keeps clamp arm 12 from pivoting or swinging freely as pivot block is rotated during a clamping sequence. The overall contour of pivot block is not critical as long as a desired axial spacing between pivot axis P and axis of rotation R can be maintained.

Figure 7:
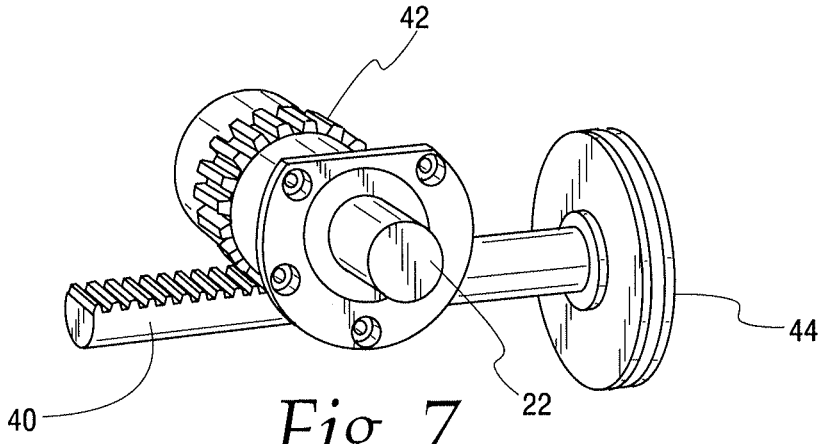
FIG. 7 is a perspective view of a gear and pinion mechanism of an actuator in the beam clamp fixture shown in FIG. 1.

Referring to FIG. 7, rack 40 is shown engaged with pinion 42 around actuator shaft 22. Rack 40 is mounted in actuator housing 20 (FIG. 5) for reciprocating motion in response to urging by piston 44.

Figure 8:
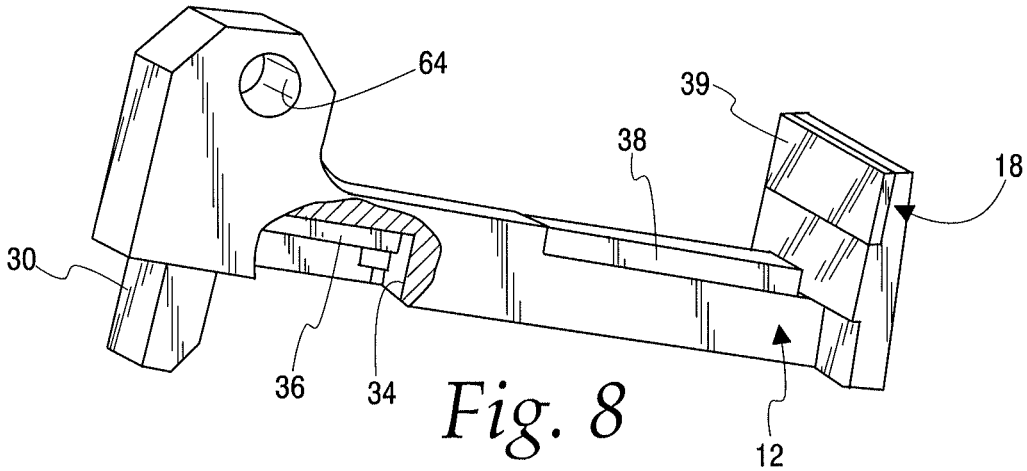
FIG. 8 is a perspective view of an elongated clamp arm in the beam clamp fixture shown in FIG. 1.

Referring to FIG. 8, clamp arm 12 terminates in hold-down jaw 18 at the distal end portion thereof and defines bore 64 in the proximal end portion thereof. Hold-down jaw 18 can be fixed to clamp arm 12 or can be removable, as desired. Bore 64 is sized to receive clamp arm shaft 16. The proximal end portion of clamp arm 12 includes pivot limiting lateral protrusion 30 which coacts with abutments 26 and 28 (FIGS. 1, 2 and 6). Recess 34 in clamp arm 12 is sized to accommodate spring-biased plunger 32 (FIG. 6). A low friction material such as polytetrafluoroethylene plate 36 in recess 34 provides a relatively low friction contact surface for spring-biased plunger 32.

To begin a clamping operation, clamp arm 12 as shown in FIG. 2 and resting on spring-biased plunger 32, is pivoted in a counterclockwise direction by counterclockwise rotation of pivot block 14, rotated by actuator shaft 22. When clamp arm 12 comes in contact with a flange of the beam to be clamped, further counterclockwise pivot of clamp arm 12 stops while the counterclockwise rotation of pivot block 14 continues. The spring of spring-biased plunger 32 is compressed, and clamp arm 12 together with hold-down jaw 18 is pulled down toward the beam. As pivot block 14 continues to move counterclockwise, protrusion 30 shifts in direction of abutment 26, and clamp arm moves linearly toward the beam until hold-down jaw 18 of clamp arm 12 is urged against the beam and the actuator stalls.

At the point in time when counterclockwise pivot of clamp arm 12 stops and clamp arm first contacts the beam, pivot axis P and axis of rotation R define a plane substantially orthogonal to the longitudinal axis of the beam being clamped. The pull down clamping force applied to the beam when jaw 18 urged against the beam is a function of torque supplied by the actuator shaft 22 and the spacing or distance D between pivot axis P and axis of rotation R, i.e., applied Force equals Torque divided by spacing D less any force exerted by the compressed spring in plunger 32.

Figure 9:
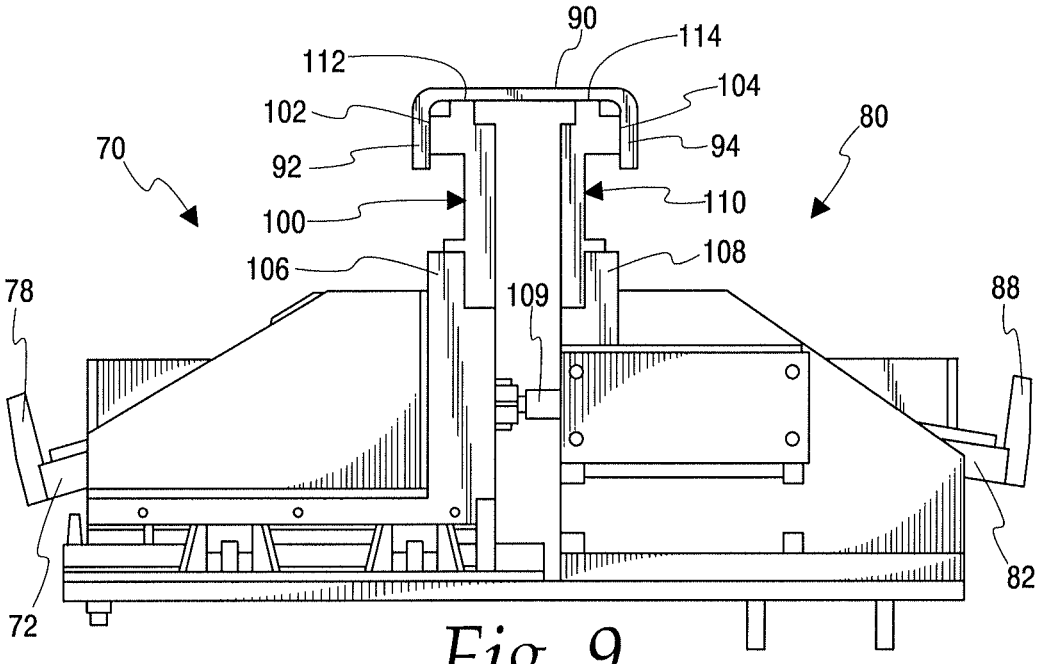
FIG. 9 is a side elevational view of a pair of opposed beam clamp fixtures with clamp arms in a released position.
Figure 10:
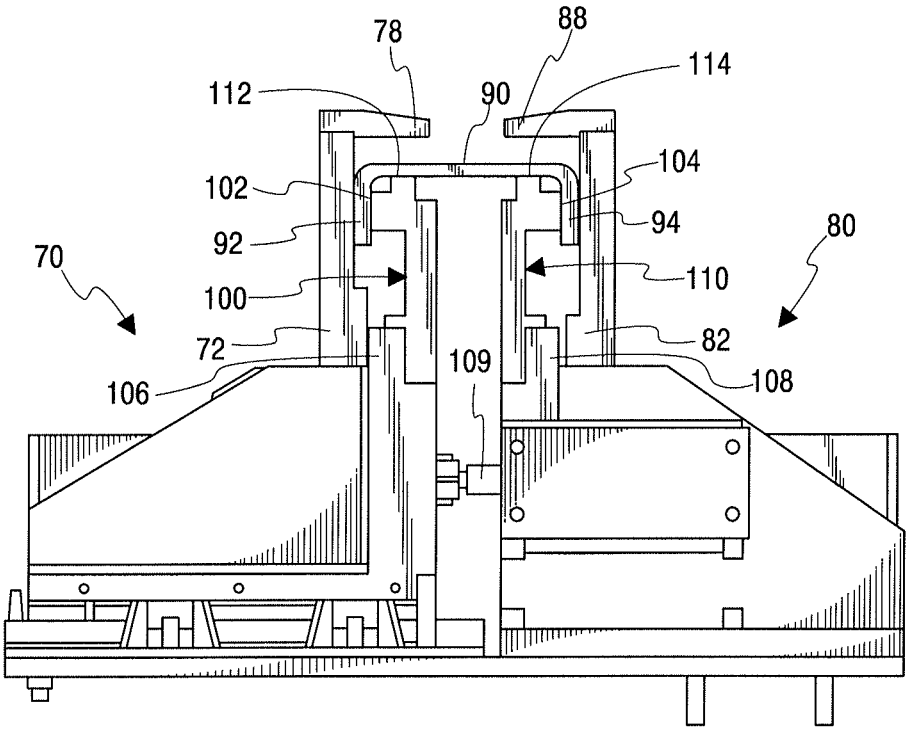
FIG. 10 is a side elevational view of the beam clamp fixture with clamp arms in contact with side flanges of a structural beam.

Beam clamping using a pair of beam clamp fixtures 70, 80 is illustrated by FIGS. 9-11. Beam clamp fixtures 70 and 80 include the same structural elements and features as beam clamp fixture 10 described hereinabove. The beam clamping operation begins with beam 90 positioned on datums 100 and 110 on inner beam clamps 106 and 108, respectively. Inner beam clamp 106 is movable relative to inner beam clamp 108 by pneumatic cylinder 109 therebetween. After beam 90 is positioned on datums 100 and 110, inner beam clamp 106 is moved toward flange 92 so that vertical datum surface 102 abuts the inner surface of flange 92 and vertical datum surface 104 abuts the inner surface of flange 94 as shown in FIG. 9. Elongated clamp arms 72 and 82 of beam clamp fixtures 70 and 80 are in a beam release position.

Thereafter, actuators operably associated with clamp arms 72 and 82 are energized and clamp arms 72 and 82 swing or pivot toward beam 90 as shown in FIG. 10 so that clamp arm 72 is urged against the outer surface of flange 92 and clamp arm 82 contacts the outer surface of flange 94. Hold-down jaws 78, 88 remain positioned above beam 90.

Continued counterclockwise rotation of associated pivot blocks brings hold-down jaws 78, 88 into contact with the surface of beam 90 urging beam 90 against datum surfaces 112, 114, thereby immobilizing beam 90 as shown in FIG. 11. When clamp arms 72, 82 first contact beam flanges 92, 94, the clamp arms are pivoted slightly in opposite direction and begin linear motion moving hold-down jaws 78, 88 toward beam 90. The linear motion ceases when hold-down jaws 78, 88 come in contact with beam 90 (FIG. 11) and the force exerted against beam 90 urging beam 90 against datums 112 and 114 equals the force supplied by the rotary actuator for each clamp arm and the actuator stalls.

To release the clamping force, rotation of pivot blocks is reversed and clamp arms 72, 82 first move up, and as clockwise rotation of pivot blocks continues, clamp arms 72, 82 disengage from beam 90 and pivot or swing away from beam 90 to the clamp release position.

During a machining operation, the beam clamp fixtures can be applied to a beam on both sides of a machining site, as required. Preferably beam clamp fixtures are utilized flanking the machining site.

Figure 12:
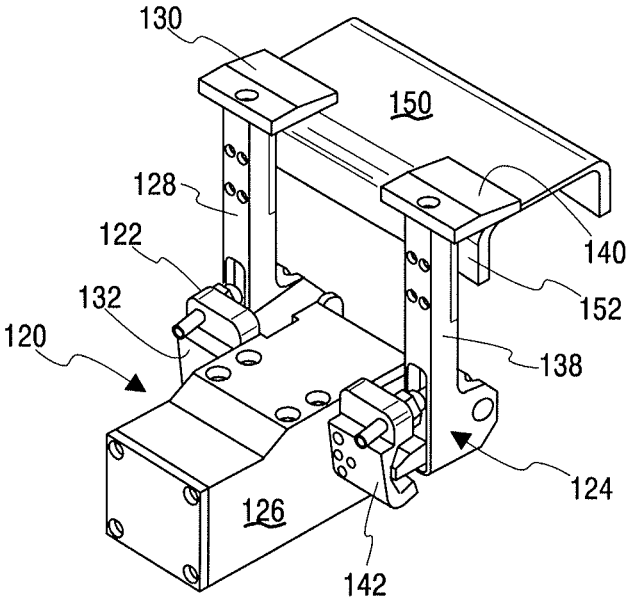
FIG. 12 is a perspective view of a beam clamp fixture with dual clamp arm assemblies.
Figure 13:
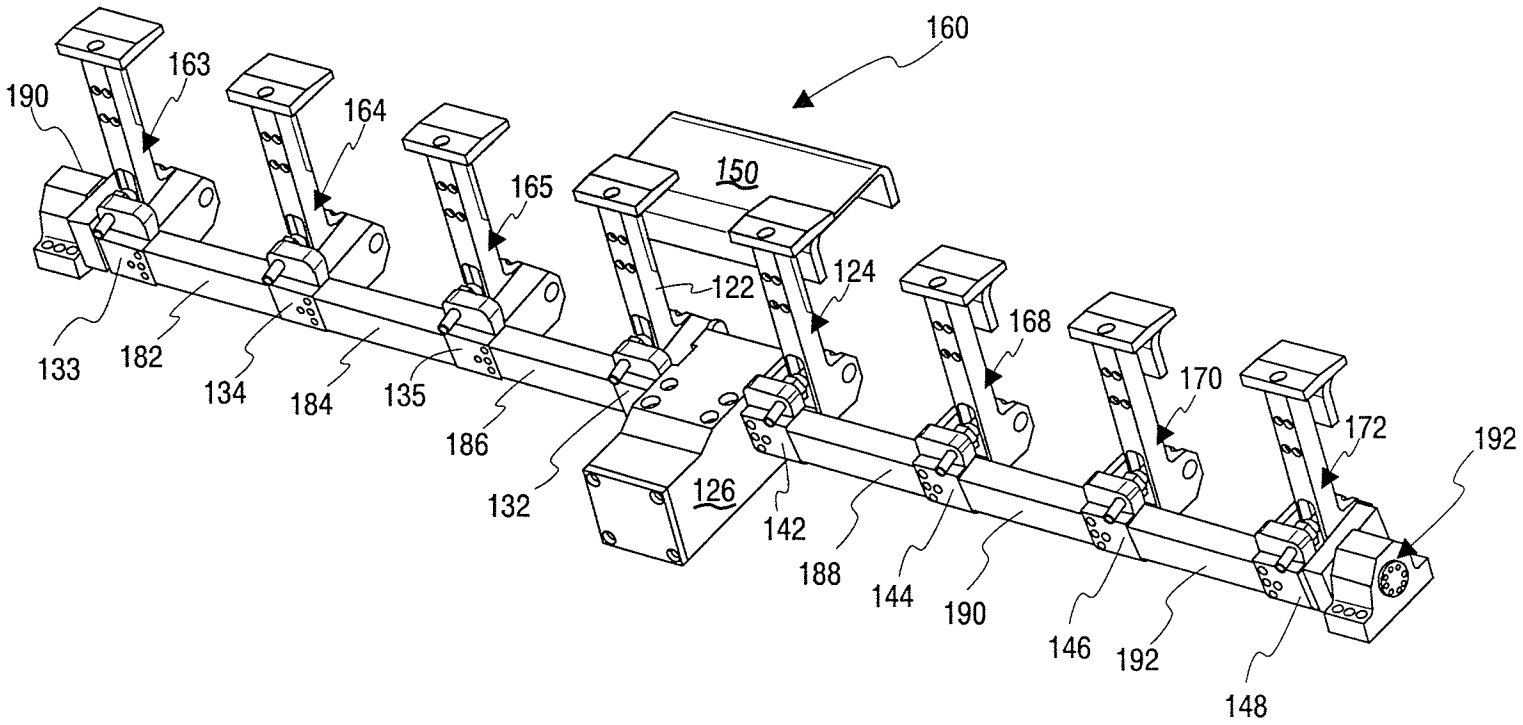
FIG. 13 is a perspective view of a beam clamp fixture with a plurality of clamp arm assemblies activated by a single actuator.

FIGS. 12 and 13 illustrate embodiments in which plural beam clamp assemblies are energized by the same actuator shaft.

In particular, FIG. 12 shows beam clamp fixture 120 provided with a pair of primary clamp arm assemblies 122 and 124 associated with an actuator shaft (not shown) that extends from both sides of actuator housing 126 in the same manner as clamp arm assembly 11 is associated with actuator shaft 22 shown in FIGS. 2, 3 and 5 and described hereinabove. Elongated primary clamp arm 128 of primary clamp arm assembly 122 terminates in hold-down jaw 130 and is pivotably mounted to pivot block 132. In a like manner, elongated primary clamp arm 138 of primary clamp arm assembly 124 terminates in hold-down jaw 140 and is pivotably mounted to pivot block 142. Pivot blocks 132 and 142 are keyed to the actuator shaft (not shown) that extends outwardly from actuator housing 126. Hold-down jaws 130 and 140 engage a top portion of beam 150 while a portion of each elongated clamp arm engages flange 152 of beam 150.

FIG. 13 shows a further beam clamp fixture 160 embodying the present invention. In this particular embodiment, the beam clamp fixture shown in FIG. 12 is provided with additional, secondary clamp arm assemblies 163, 164, 165, 168, 170 and 172 that operate in unison with primary clamp arm assemblies 122 and 124. The secondary clamp arm assemblies include the same structural elements and features as beam clamp fixture 10 described hereinabove except that secondary pivot blocks 133, 134, 135, 144, 146 and 148 are not keyed to the actuator shaft extending from actuator housing 126 but instead are rigidly connected to a primary pivot block. Specifically, secondary pivot blocks 133, 134 and 135 of respective secondary beam clamp assemblies 163, 164 and 165 are rigidly connected to one another and to primary pivot block 132 of primary clamp arm assembly 122 by spacer bars 182, 184 and 186, respectively, and are rotatable in unison with primary pivot block 132. In a like manner, secondary pivot blocks 144, 146 and 148 of respective beam clamp assemblies 168, 170 and 172 are rigidly connected to one another and to primary pivot block 142 by spacer bars 188, 190 and 192, respectively. Secondary pivot blocks 144, 146 and 148 are rotatable in unison with primary pivot block 142. Bearings 190 and 192 are provided on opposite distal ends of the array of beam clamp assemblies in beam clamp fixture 160.

The foregoing description and the drawings are illustrative of the claimed invention but are not to be taken as limiting. Other variants and rearrangements of parts within the spirit and scope of the claimed invention are possible and will readily present themselves to those skilled in the art.

The invention claimed is:

1. A beam clamp fixture which comprises an actuator having a rotatable actuator shaft defining an axis of rotation;

a rigid pivot block keyed to the actuator shaft for rotation about the axis of rotation, having a clamp arm shaft offset from the axis of rotation and defining a pivot axis aligned with the axis of rotation but spaced therefrom;

an elongated clamp arm pivotably mounted on the clamp arm shaft for movement along a pivot arc, having a pivot limiting protrusion positioned to coact with the pivot block, and terminating in a hold-down jaw at a distal end portion of the elongated clamp arm; and a pair of spaced, opposing abutments in the pivot block defining a range of linear motion by the elongated clamp arm;

the elongated clamp arm having a longitudinal axis that is at an acute angle to a pivot plane defined by the pivot axis and the axis of rotation when in a beam release position.

2. A beam clamp fixture which comprises a housing;

an actuator in the housing and having a rotatable actuator shaft extending outwardly from the housing and defining an axis of rotation;

an elongated, rigid pivot block, having first and second end portions, the first end portion being mounted to the actuator shaft for rotation about said axis of rotation, and having a clamp arm shaft fixed at the second end portion and defining a pivot axis spaced from but aligned with said axis of rotation;

an elongated clamp arm pivotably mounted to the clamp arm shaft provided with a lateral protrusion and terminating in a hold-down jaw; and a pair of spaced opposing abutments on the pivot block and coacting with the lateral protrusion of the elongated clamp arm and limiting range of linear motion by the elongated clamp arm;

the elongated clamp arm having a longitudinal axis that is at an acute angle to a pivot plane defined by the pivot axis and the axis of rotation when in a beam release position.

3. The beam clamp fixture in accordance with claim 2 wherein the actuator is a rack and pinion mechanism and the pinion is carried by the actuator shaft.

4. The beam clamp fixture in accordance with claim 3 wherein the rack is pneumatically driven.

5. The beam clamp fixture in accordance with claim 3 wherein the rack is hydraulically driven.

6. The beam clamp fixture in accordance with claim 3 wherein the rack is electrically driven.

7. The beam clamp fixture in accordance with claim 2 wherein the actuator is a direct drive torque motor.

8. The beam clamp fixture in accordance with claim 2 wherein a spring-biased plunger is provided on the pivot block and contacts the elongated clamp arm urging the elongated clamp arm against a beam flange when the elongated clamp arm abuts the beam flange.

9. The beam clamp fixture in accordance with claim 2 wherein the spaced opposing abutments are opposite walls of a contoured pocket defined by the pivot block.

10. The beam clamp fixture in accordance with claim 2 wherein the elongated clamp arm is provided with a polytetrafluoroethylene contact surface.

11. The beam clamp fixture in accordance with claim 2 wherein the elongated clamp arm and the hold-down jaw are provided with a polytetrafluoroethylene contact surface.

12. The beam clamp fixture in accordance with claim 2 wherein the elongated clamp arm defines an elongated recess, a spring-biased plunger is provided on the pivot block, and the spring-biased plunger is slidably received in the elongated recess.

13. The beam clamp fixture in accordance with claim 9 wherein a polytetrafluoroethylene contact surface is provided in the elongated recess and the spring-biased plunger contacts the polytetrafluoroethylene contact surface.

14. A beam clamp fixture having a pair of beam clamp assemblies operated by a single actuator with an actuator shaft defining an axis of rotation, each beam clamp assembly comprising a rigid pivot block keyed to the actuator shaft for rotation about the axis of rotation, having a clamp arm shaft offset from the axis of rotation and defining a pivot axis aligned with the axis of rotation but spaced therefrom;

an elongated clamp arm pivotably mounted on the clamp arm shaft for movement along a pivot arc, having a pivot limiting protrusion positioned to coact with the pivot block, and terminating in a hold-down jaw at a distal end portion of the elongated clamp arm; and a pair of spaced, opposing abutments in the pivot block defining a range of linear motion by the elongated clamp arm;

the elongated clamp arm having a longitudinal axis that defines an acute angle with a pivot plane defined by the pivot axis and the axis of rotation when in a beam release position.

15. An array of beam clamp assemblies operated by a single actuator having an actuator shaft defining an axis of rotation and comprising a pair of rigid primary pivot blocks flanking the actuator and keyed to the actuator shaft for rotation about the axis of rotation, each primary pivot block having a primary clamp arm shaft offset from the axis of rotation and defining a primary pivot axis aligned with the axis of rotation but spaced therefrom;

an elongated primary clamp arm pivotably mounted to the primary clamp arm shaft of each primary pivot block for movement along a pivot arc, having a pivot limiting protrusion positioned to coact with the primary pivot block, and terminating in a hold-down jaw at the distal end portion of the elongated clamp arm;

a pair of spaced abutments in each primary pivot block defining a range of linear motion by the elongated clamp arm;

at least one secondary pivot block aligned with each primary pivot block, rigidly connected thereto by a spacer bar, having a secondary clamp arm shaft offset from the axis of rotation and defining a secondary pivot axis aligned with said axis of rotation but spaced therefrom and coinciding with the primary pivot axis;

an elongated secondary clamp arm pivotably mounted on the secondary clamp arm shaft for movement along a pivot arc, having a pivot limiting protrusion positioned to coact with the secondary pivot block, and terminating in a hold-down jaw at a distal end portion thereof; and a pair of spaced, opposing abutments in the secondary pivot block defining a range of linear motion by the elongated secondary clamp arm.

* * * * *